US005320772A

United States Patent [19]

Tricca

[11] Patent Number: 5,320,772

[45] Date of Patent: Jun. 14, 1994

[54] COMPOSITION FOR CLEANING FRUITS AND VEGETABLES

[75] Inventor: R. Eugene Tricca, Caldwell, N.J.

[73] Assignee: Empire Products Packaging Development, Inc., New York, N.Y.

[21] Appl. No.: 885,284

[22] Filed: May 18, 1992

[51] Int. Cl.[5] ..... C11D 7/50; C11D 3/20

[52] U.S. Cl. ..... 252/160; 252/89.1; 426/321; 426/326; 426/331; 426/333; 206/812

[58] Field of Search ..... 252/89.1, 160; 426/321, 426/326, 331, 333; 206/812

[56] References Cited

U.S. PATENT DOCUMENTS

| | | | |
|---|---|---|---|
| 4,024,078 | 5/1977 | Gilbert et al. | 252/551 |
| 4,177,294 | 12/1979 | Lehmann et al. | 426/271 |
| 4,226,736 | 10/1980 | Bush et al. | 252/135 |
| 4,228,048 | 10/1980 | Tesdahl | 260/17.4 UC |
| 4,336,273 | 6/1982 | Lee | 426/321 |
| 4,772,501 | 9/1988 | Johnson et al. | 428/74 |
| 4,808,330 | 2/1989 | Chung | 252/170 |
| 5,049,440 | 9/1991 | Bornhoeft | 428/288 |
| 5,122,541 | 6/1992 | Eggersperger et al. | 514/578 |

*Primary Examiner*—Christine Skane
*Assistant Examiner*—Michael P. Tierney
*Attorney, Agent, or Firm*—Davis Hoxie Faithfull & Hapgood

[57] ABSTRACT

A cleaning composition for cleaning the surfaces of edible fresh fruits and vegetables. The composition comprises water and a preservative, and preferably also a co-solvent with a dielectric constant less than that of water, a surfactant, a flavorant, and a buffering agent to maintain the composition's pH within the range of 2 to 9. The invention further comprises a fibrous wiper impregnated with the cleaning composition for wiping the fresh produce, and a dispenser for storing the impregnated fibrous wiper.

6 Claims, 2 Drawing Sheets

COMPOSITION FOR CLEANING FRUITS AND VEGETABLES

BACKGROUND OF THE INVENTION

1. Field of the Invention

This invention is directed to a composition for removing residue from the surfaces of edible fresh fruits and vegetables prior to their consumption. The invention also includes a fibrous wiper impregnated with the cleaning composition, and to a dispenser for consumer use for storing the impregnated fibrous wiper.

2. Description of the Prior Art

Compositions for cleaning the edible skins of fresh fruits and vegetables must satisfy two often inconsistent criteria. The compositions must clean the fresh fruits and vegetables and not detrimentally affect the edibility or palatability of the produce.

Several wet wiper products are known which are directed to cleaning human skin. In U.S. Pat. No. 4,772,501 Johnson et al. disclose such a wet wiper product comprising a fibrous wipe saturated with a liquid preservative composition composed of citric acid, sorbic acid and water. A sealed envelope is disclosed for storing the wet wiper product as well as an optional ingredient to moisturize the skin of the user. In U.S. Pat. No. 5,049,440 Bornhoeft et al. disclose an antimicrobially active wet wiper product comprising a fibrous wipe impregnated with a hypotonic liquid preservative composition composed of water, a "naturally occurring organic acid" (citric acid, sorbic acid, etc.), and a "naturally occurring" salt (sodium chloride, etc.), and a sealed envelope to enclose the wiper. A skin moisturizer is disclosed as an optional ingredient. Compositions for cleaning fresh fruits and vegetables, however, are not disclosed.

SUMMARY OF THE INVENTION

The composition of the present invention is a detersive liquid which removes soils from the surfaces of fresh fruits and vegetables without detrimentally affecting the palatability of the produce. The cleaning composition comprises water and a preservative. Preferably, the cleaning composition also includes a co-solvent with a dielectric constant less than that of water, a surfactant, a flavorant, and a buffering agent to maintain the composition's pH within the range of 2 to 9. The present invention further includes a fibrous wiper impregnated with the cleaning composition for wiping the fresh produce, and a dispenser for storing the impregnated fibrous wiper.

DETAILED DESCRIPTION OF THE INVENTION

Figure 1:
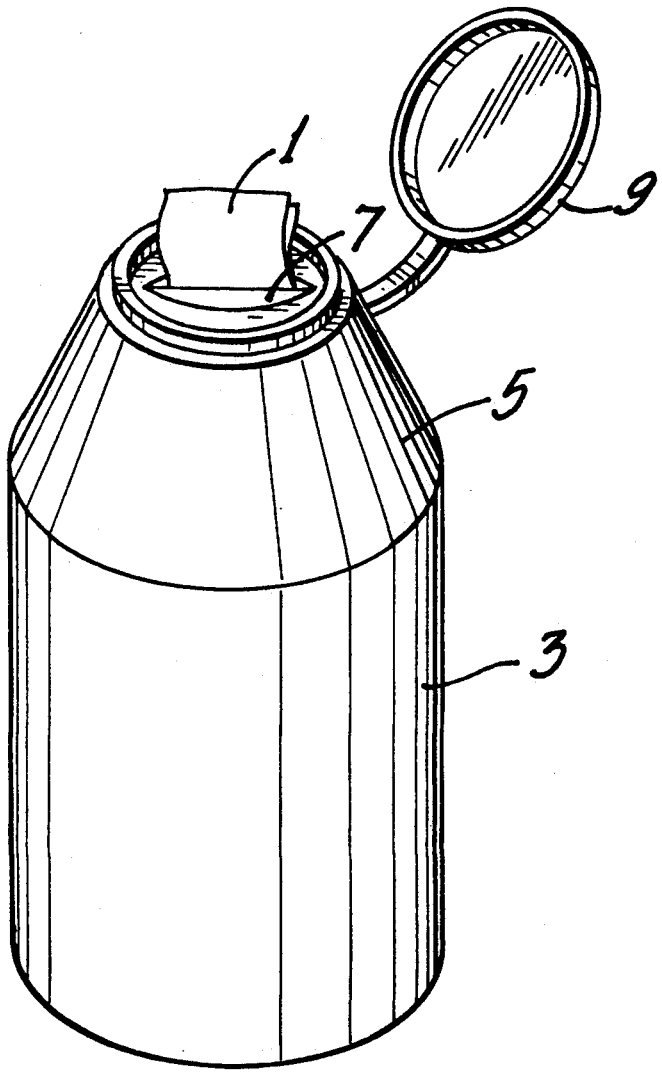
FIG. 1 illustrates one embodiment of a dispenser for the fibrous wipers.

The cleaning composition of the present invention is designed to remove soils from the surfaces of fresh fruits and vegetables. The present composition is composed of ingredients that are approved by the Food & Drug Administration (FDS) as "Generally Recognized As Safe" (GRAS). They were picked for their ability to safely remove various residues commonly found on the surfaces of fresh fruits and vegetables. In general these residues comprise two types of soils; natural and artificial. Natural soils consist of a complex mixture of organic matter (solid or semisolid) and particulate matter comprised of various microorganisms, natural oils, oxidation products, airborne soil particles, and dust. Artificial soils include agricultural pesticides and artificial waxes used to coat fruits and vegetables.

Preferably, a fibrous wiper is employed to apply the cleaning composition of the present invention to fruits and vegetables. The fibrous wiper can be a woven or non-woven web. The web is preferably of an open weave and of a texture that is rough rather than smooth, to assist in abrading and removing and holding dirt and detritus from the skin of the produce.

Webs composed of natural or synthetic fibers are suitable. Suitable natural fibers include cellulosic fibers, such as wood pulp fibers, and cotton and wool fibers. Suitable synthetic fibers include those derived from any of various synthetic resins including polyolefins, polyesters, polyamides, etc. Techniques for the manufacture of woven webs are known in the art. A cotton, terry pile fabric is a suitable woven web.

Non-woven webs are preferred because such webs are generally less expensive to produce, and have a more generally open surface for receiving and holding dirt and debris removed from the produce treated. The non-woven fibers can be bonded by any of various methods known in the art. Suitable mechanical bonding techniques include carding, air-laying, wet-laying, or needle punching the web. The non-woven web can be further bonded with a chemical additive, such as a latex binder or a polymeric powder which can be applied in a thermal bonding operation. Thermal bonding is particularly suitable where the web comprises two synthetic fibers having different melting points. Other manufacturing techniques for making woven and non-woven webs can also be used.

Dispensers for holding fibrous wipers impregnated with the cleaning composition can be of any suitable form. A sealed envelope can be used to hold a fibrous wipe saturated with the cleaning composition until the time of use. Such an envelope is preferably composed of a plastic material impermeable to air and the vapors of the ingredients comprising the cleaning composition. A preferred dispenser is a resealable container that can hold several fibrous wipers impregnated with the cleaning solution and that is essentially air tight to prevent the evaporation of the volatile components of the cleaning composition. Such a resealable container can be a rectangular or cylindrical plastic container with a removable lid and a diaphragm through which a fibrous wipe is pulled. Such dispensers are commercially available from a variety of sources.

FIG. 1 illustrates a fibrous wiper 1 pulled partially from cylindrical container 3 in which it was stored. Fibrous wiper 1 is impregnated with the cleaning solution of the present invention. Container 3 is intended to hold several such wipers, preferably in the form of a web or continuous roll that can be joined along lines of perforations that permit a section to be separated after it is drawn through the diaphragm. The wipers can be impregnated with the cleaning solution either before or after they are placed in container 3. Fibrous wiper 1 is pulled through diaphragm 7 in top 5. To help preserve the sterility of the fibrous wipers stored within container 3 and to prevent evaporation of the cleaning composition, diaphragm 7 can be sealed with removable lid 9 which is attached to container 3. Top 5 can be removed from container 3 to refill the container with fibrous wipers. Preferably, container 3, top 5 and lid 9 are composed of a plastic material that is rigid or shape retaining.

Figure 2:
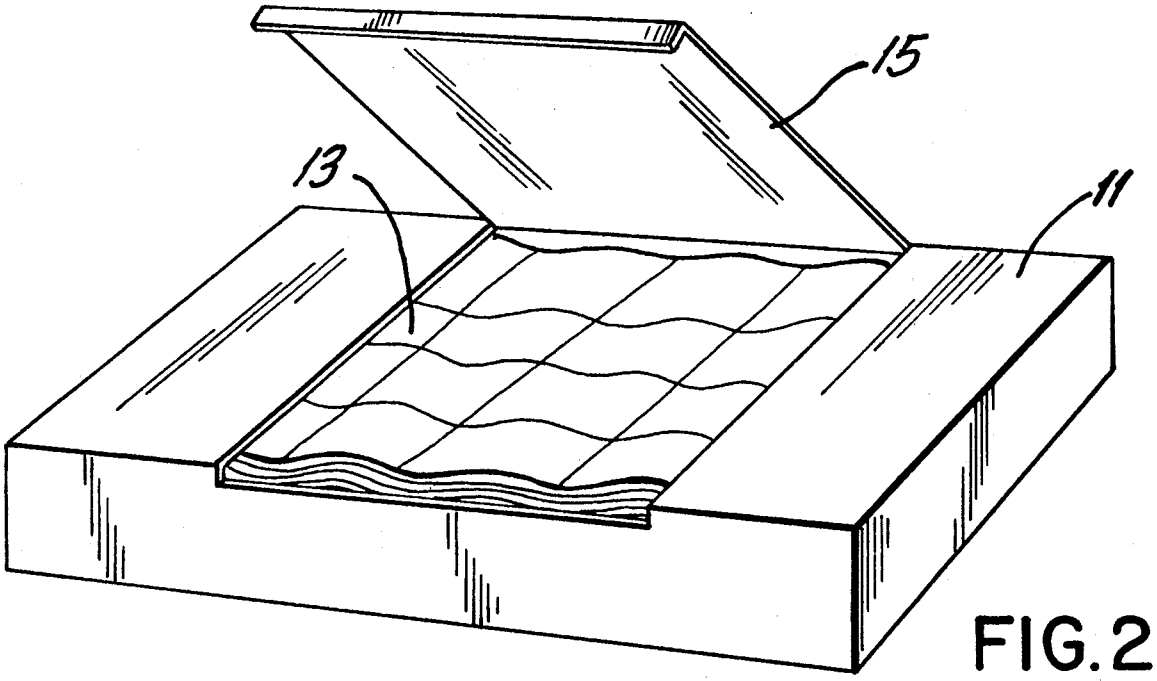
FIG. 2 illustrates another embodiment of a dispenser for the fibrous wipers of the invention.

FIG. 2 illustrates a rectangular container 11 in which several wipers 13 are placed. The wipers 13 are impregnated with the cleaning solution of the present invention. The wipers 13 can already be separated or they can be joined by perforations. The container 11 can be sealed and reopened by lid 15, which allows container 11 to be periodically refilled. Preferably, container 11 and lid 15 are composed of a plastic material.

An essential component of the composition of the present invention is the solvent(s). Water is the primary solvent. Soils, however, are either soluble or insoluble in water. For this reason it is preferable to formulate a mixed solvent system. The co-solvent(s) should have a dielectric constant less than that of water to facilitate removal of less polar (hydrophobic) surface residues. Suitable co-solvents for the present invention are ethyl alcohol, polyoxyethylene glycols, and polyhydric alcohols such as sorbitol, glycerol, propylene glycol, xylitols and polyols. Ethyl alcohol, U.S.P. XVI (95% by vol), is the preferred co-solvent comprising from about 5% to 40%, preferably from about 10% to 25%, by weight of the composition (w/w).

Ethyl alcohol is preferred for several reasons. First, it facilitates evaporation of the composition, thereby quickly drying the produce. Second, it is an excellent solubilizing agent for auxiliary components such as a flavorant. And finally, in combination with preservatives, ethyl alcohol facilitates self-preservation by reducing water activity. As the alcohol concentration increases, less water is available for microbial growth during storage of the product.

Preservatives are another component of this invention. The preservatives applied by the fibrous wipe should provide excellent preservative activity against various microorganisms, particularly the five pathogenic microorganisms identified in the U.S.P. XXI Antimicrobial Preservatives-Effectiveness twenty-eight day challenge test: *Aspergillus niger, Candida albicans, Staphylococcus aureus, Pseudomonas aeruginosa,* and *Escherichia coli.*

Examples of preservatives for the present invention include naturally occurring organic acids such as sorbic acid, citric acid, benzoic acid, propionic acid and mixtures thereof, and esters of para-hydroxy benzoic acid, such as methyl paraben and propyl paraben. The preferred preservatives are sorbic acid and benzoic acid. Sorbic acid is used in a concentration of from 0.01 to 0.25% w/w, and preferably from about 0.10% to 0.20% w/w (by weight of the composition). Benzoic acid is used in a concentration of from 0.02 to 0.3% w/w, and preferably from 0.08% to 0.15% w/w.

It is usually desirable to include a surfactant in the composition of the present invention to facilitate removal of surface residues. Surfactants also assist in the solubilization of flavor oils if such oils are present in the formulation. While there are many types of surfactants, anionics and nonionics are preferred because of their wide use in food products and low toxicity.

The anionic surfactants are most preferred. Useful anionic surfactants include the following: higher fatty acid monoglyceride monosulfates, such as the sodium salts of the monosulfates of the monoglycerides of hydrogenated coconut oil fatty acids; higher alkyl sulfates such as sodium lauryl sulfate; higher alkyl aryl sulfates, such as sodium lauryl sulfate; and higher alkyl aryl sulfonates, such as sodium dodecyl benzene sulfonate and mono- and di-methyl napthalene sulfonates. The anionic surfactants are provided in the range of 0.05% w/w to about 5% w/w anionic compound, and preferably in the range of 0.1% to 0.5% w/w (by weight of the composition). Sodium lauryl sulfate is a preferred anionic surfactant because of its low toxicity, excellent detersive properties and stability at low pH. A preferred grade of sodium lauryl sulfate is Empicol 0303V marketed by Albright & Wilson Americas Inc.

Useful nonionic surfactants include mixtures of laurate esters of sorbitol and sorbitol anhydrides consisting predominantly of the monoester condensed with about 15–25 moles of ethylene oxide and block co-polymers of ethylene oxide and propylene oxide sold as Pluronics made by BASF Corporation. Polyoxyethylene (20) sorbitan monooleate (polysorbate 80) is a useful nonionic surfactant. The preferred nonionic surfactants are the "Tweens" available from ICI Americas, Wilmington, Del. Tween 80, 60 and 65 are particularly useful. Nonionic surfactants are used in the present invention in the range of 0.05% to about 5% w/w, and preferably from about 0.05 to 2.0% w/w.

Effective amounts of various conventional auxiliary materials such as flavorants, buffering agents, sequestrants and acidic agents also may be employed in the present invention.

A preferred auxiliary ingredient is a flavorant. The flavorant is included to provide an aroma which will serve as a signal or sensory cue to the consumer and heighten their awareness and appreciation of the product's action. Flavorants include essential oils and synthetic flavoring substances generally recognized as safe (GRAS) as outlined in the 21 CFR. Flavorants such as oil of lemon and limonene are particularly useful because they typically are formulated in consumer household cleaning products. Flavorants are generally used in the present composition at levels of from about 0.05% to about 0.5% w/w, and preferably from 0.1% to 0.3% w/w.

Other optional components of the present composition are buffering agents, sequestrants and acidulants. They serve to adjust and maintain the pH of the composition within the range of 2.0 to 9.0, and preferably within the range of 2.5 to 4.0. Examples of these agents include acidic and buffering agents such as acetic acid, succinic acid, fumaric acid, lactic acid, malic acid, tartaric acid, tetrasodium pyrophosphate, sodium acid pyrophosphate, disodium edetate, phosphoric acid, hydrochloric acid, sodium bicarbonate, sodium tripolyphosphate, and disodium phosphate. These agents can be present in the composition in the range of from 0.05% to 2.0% w/w, and preferably from 0.1% to 0.5% w/w.

Examples 1–2 illustrate specific formulations of cleaning compositions according to the present invention. Concentrations are in percentages by weight of the composition (% w/w).

EXAMPLE NO. 1

A cleaning composition suitable for home use, with a citrus flavorant, has a formulation as follows:

| Ingredient | Concentration (% w/w) |
|---|---|
| Water | 78.90 |

-continued

| Ingredient | Concentration (% w/w) |
|---|---|
| Ethyl Alcohol (95%) | 20.00 |
| Polysorbate 80 | 0.30 |
| Disodium Edetate | 0.20 |
| Sodium Lauryl Sulfate | 0.10 |
| Benzoic Acid | 0.10 |
| Sorbic Acid | 0.20 |
| Flavorant (Citrus Type) | 0.20 |
| | 100.00% |

The final pH of the solution is adjusted to 3.0 by addition of phosphric acid.

EXAMPLE NO. 2

A composition for cleaning particularly soiled fruits and vegetables, such as at an outside fruit stand, is as follows:

| Ingredient | Concentration (% w/w) |
|---|---|
| Water | 56.85 |
| Ethyl Alcohol | 30.00 |
| Propylene Glycol | 10.00 |
| Sodium Lauryl Sulfate | 0.25 |
| Sodium Dodecyl Benzene Sulfonate | 0.25 |
| Polysorbate 80 | 2.00 |
| Benzoic Acid | 0.20 |
| Sorbic Acid | 0.15 |
| Disodium EDTA | 0.20 |
| Flavor (Citrus Type) | 0.10 |
| | 100.00% |

The final pH of the solution is adjusted to 3.0 by addition of phosphoric acid.

What is claimed is:

1. A composition for cleaning edible fruits and vegetables comprising water, ethyl alcohol, laurate esters of sorbitol and sorbitol anhydrides consisting predominantly of the monoester condensed with about 15–25 moles of ethylene oxide, sodium lauryl sulfate, benzoic acid and sorbic acid, wherein the pH of said composition is within the range of from 2.0 to 9.0.

2. The composition of claim 1 in which water is present within the range of 5% to 95% w/w, ethyl alcohol is present within the range of 2% to 40% w/w, laurate esters of sorbitol and sorbitol anhydrides consisting predominantly of the monoester condensed with about 15–25 moles of ethylene oxide are present within the range of 0.05% to 5% w/w, sodium lauryl sulfate is present within the range of 0.5% to 5% w/w, benzoic acid is present within the range of 0.02% to 0.3% w/w, and sorbic acid is present within the range of 0.1% to 0.25% w/w.

3. The composition of claim 1 which further comprises a flavorant at about 0.2% w/w and disodium edetate at about 0.2% w/w, and which comprises water at about 78.9% w/w, ethyl alcohol at about 20.0% w/w, laurate esters of sorbitol and sirbitol anhydrides consisting predominantly of the monoester condensed with about 15–25 moles of ethylene oxide at about 0.3% w/w, sodium lauryl sulfate at about 0.1% w/w, benzoic acid at about 0.1% w/w, and sorbic acid at about 0.2% w/w.

4. A composition for cleaning edible fruits and vegetables consisting of ethyl alcohol within the range of 10% to 25% w/w, sorbic acid within the range of 0.1% to 0.2% w/w, benzoic acid within the range of 0.08% to 0.15% w/w, flavorant within the range of 0.1% to 0.3%, citric acid in an amount effective to place the pH of the composition in the range of 2.5 to 4.0 with the remainder being water.

5. A fibrous wiper impregnated with a composition for cleaning edible fruits and vegetables, said composition comprising water, ethyl alcohol, laurate esters of sorbitol and sorbitol anhydrides consisting predominantly of the monoester condensed with about 15–25 moles of ethylene oxide, sodium lauryl sulfate, benzoic acid and sorbic acid, wherein the pH of said composition is within the range of from 2.0 to 9.0.

6. The dispenser of claim 5 wherein said dispenser comprises an essentially air-tight, resealable plastic container with a top and bottom, said top having a diaphragm through which said fibrous wipe can be pulled and a removable lid which engages the top and seals the area defining the diaphragm.

* * * * *

UNITED STATES PATENT AND TRADEMARK OFFICE
CERTIFICATE OF CORRECTION

PATENT NO. : 5,320,772

DATED : June 14, 1994

INVENTOR(S) : Tricca

It is certified that error appears in the above-identified patent and that said Letters Patent is hereby corrected as shown below:

Column 1, line 65, "FDS", should be -- FDA --.

Column 2, line 1, after soils, change ";" to -- : --.

Claim 2, Column 6, line 6, change "0.5%" to -- 0.05% --.

Claim 3, Column 6, line 15, change "sirbitol anhydrides" to -- sorbitol anhydrides --.

Claim 6, Column 6, should be deleted and replaced by:

--6. A dispenser containing at least one fibrous wiper impregnated with a composition for cleaning edible fruits and vegetables, said composition comprising the composition of claim 4. --

Signed and Sealed this

Thirteenth Day of December, 1994

*Attest:*

Bruce Lehman

BRUCE LEHMAN

*Attesting Officer*

*Commissioner of Patents and Trademarks*